US005288213A

United States Patent [19]

Nasr

[11] Patent Number: 5,288,213

[45] Date of Patent: Feb. 22, 1994

[54] PUMP HAVING AN INTERNAL PUMP

[75] Inventor: Ali M. Nasr, Summit, N.J.

[73] Assignee: PMC Liquiflo Equipment Co., Inc., Warren, N.J.

[21] Appl. No.: 978,628

[22] Filed: Nov. 19, 1992

Related U.S. Application Data

[63] Continuation-in-part of Ser. No. 892,752, Jun. 3, 1992, abandoned.

[51] Int. Cl.[5] ..... F04D 13/14

[52] U.S. Cl. ..... 417/368; 417/370; 417/372; 417/420

[58] Field of Search ..... 417/368, 370, 372, 420

[56] References Cited

U.S. PATENT DOCUMENTS

| | | | |
|---|---|---|---|
| 3,513,942 | 5/1970 | Sato | 417/420 |
| 4,812,108 | 3/1989 | Kotera | 417/368 |
| 4,990,055 | 2/1991 | Korenblit | 415/144 |

*Primary Examiner*—Richard A. Bertsch
*Assistant Examiner*—David W. Scheuermann
*Attorney, Agent, or Firm*—Paul J. Cook

[57] ABSTRACT

Pump apparatus having a wear end and a pump end is provided with means for preventing fluid being pumped from entering the wear end. An internal pump is positioned between the wear end and the pump end of sealless pumps to direct small quantities of fluid from the wear end to the pump end at a pressure which prevents fluid in the pump end to pass into the wear end.

13 Claims, 4 Drawing Sheets

PUMP HAVING AN INTERNAL PUMP

REFERENCE TO RELATED APPLICATION

This application is a continuation-in-part of application Ser. No. 07/892,752, filed Jun. 3, 1992, now abandoned.

BACKGROUND OF THE INVENTION

This invention relates to a pumping apparatus having a wear end and a pump end having an internal pumping means to prevent fluid in the pump end from entering the wear end. More particularly, this invention relates to a sealless pumping apparatus having a pump end and a wear end wherein a rotor portion of the wear end is sealed from the environment around the wear end and wherein an internal pumping means is provided to prevent fluid in the pump end from entering the wear end.

Pumps generally include a pump end where incoming liquid is pressurized for subsequent recovery through an outlet and a wear end where the parts subject to wear such as bearings, shaft, thrust washers, driven magnet or the like are located. Pumps of all types, including centrifugal, gear or screw pumps rely on a seal or a magnetic drive or a canned motor design in order to minimize leakage from the pump. The relatively simple designs of the sealed pumps have a seal which will wear and, therefore, eventually leak.

In canned motor design pumps and magnetic drive pumps, the rotor portion of the pump is separated and sealed from the stator portion of the pump or the drive magnet portion, respectively by means of a seal known as a can, lining or shell. The can prevents fluid in the rotor portion from contacting the environment. Since a rotating shaft does not rotate through the can, there is no need to provide a seal between the can and environment. The can portion of the pump is formed of a metallic composition to render it resistant to a variety of liquids being pumped, particularly hydrocarbon compositions and corrosive liquids. However, the type of liquids that can be pumped also is limited such as acidic compositions which degrade the can metallic composition, slurries, the solid portion of which rapidly deteriorate the wear end and hot liquid composition which also deteriorate the wear end. In the case of slurries, it has been proposed to utilize a screen or a filter between the pump end and the wear end to eliminate contact between the solid portion of the slurry and the wear end. The use of filter screens is undesirable since they become rapidly plugged thereby depleting the wear end of needed heat exchange and lubricating liquid. In addition, in magnetic drive pumps, the use of metallic cans creates eddy current losses which consume energy and which produce undesirable heat that must be removed from the wear end. In addition, since presently available canned motor pumps and magnetic drive pumps rely upon the liquid being pumped to effect lubrication and heat removal in the wear end, they cannot be run dry accidently without destroying the pump. With either of the magnetic drive or canned motor sealless pump designs, the units do not have seals but they do have internal bearings and thrust washers and shafts which depend on the fluid being pumped for lubrication. Accordingly, these parts will wear over time as well. In the event that the liquid being pumped is non-lubricating, abrasive or crystalline or very hot or cold, the bearings, washers and shafts can be damaged quickly and render the pumps either too expensive or impractical to repair.

U.S. Pat. No. 4,290,611 discloses a pumping seal utilizing a plate having spiral grooves as a pump. U.S. Pat. No. 5,090,712 discloses a pumping seal having an alternative discontinuous grooved surface.

Some designs provide clean pressurized liquid to the wear end and allow it to flow through a bushing into the pump end. Said designs require a flow as low as 0.6 gallon per minute which makes the design impractical and said flows will increase as the throttle bushing wears. Further, the use of a throttle bushing does not prevent liquid from entering the wear end when the pump is idle and therefore aggravates wear in the wear end resulting in limited durability. By contrast, this invention permits flows of as low as 0.4 gallons per day and seals the wear end from the pump end when the pump is idle.

Accordingly, it would be desirable to provide a pump which prevents the fluid being pumped from entering a wear end of a pump. This will allow the use of the pump in slurries, low viscosity or thin liquids, high temperatures, afford "run dry" protection and greatly extend the life of the wear end. It would also be desirable to provide a magnetic drive pump which can utilize a nonmetallic can in order to avoid eddy current loss but removes the negative aspects of the nonmetallic can being the only seal to the environment.

SUMMARY OF THE INVENTION

In accordance with this invention, a pump apparatus is provided having a pump end and a wear end wherein fluid in the pump end is prevented from entering the wear end by use of an internal pump positioned between the pump end and the wear end. Apparatus in the wear end includes a rotor means for including a rotatable shaft and a stator wherein the rotor and stator are sealed from each other by a can structure. The pump end includes pumping means such as an impeller mounted on the same rotatable shaft when rotating. The internal pump directs small quantities of fluid under pressure from the wear end to the pump end while preventing the passage of fluid from the pump end into the wear end. When idle, the device prevents flow from the pump end into the wear end by forming a seal. Thus, the internal pump eliminates the problems associated with non-lubricating fluids, dry running mishaps, and the pumping of slurries with sealless pumps. In addition, it eliminates the corrosive or deteriorating affect of the fluid being pumped by the pump apparatus in the wear end. Reservoirs and a flow system are provided in the wear end to permit adequate liquid to cool and flush bearings and sufficient liquid for flow required for the internal pump. Cooling and flushing are required to prevent damage to the wear end of the pump. The pumps of this invention differ from prior art sealless pumps which do not include a sealing means or pump means between the wear end and the pump end.

DESCRIPTION OF SPECIFIC EMBODIMENTS

Figure 1:
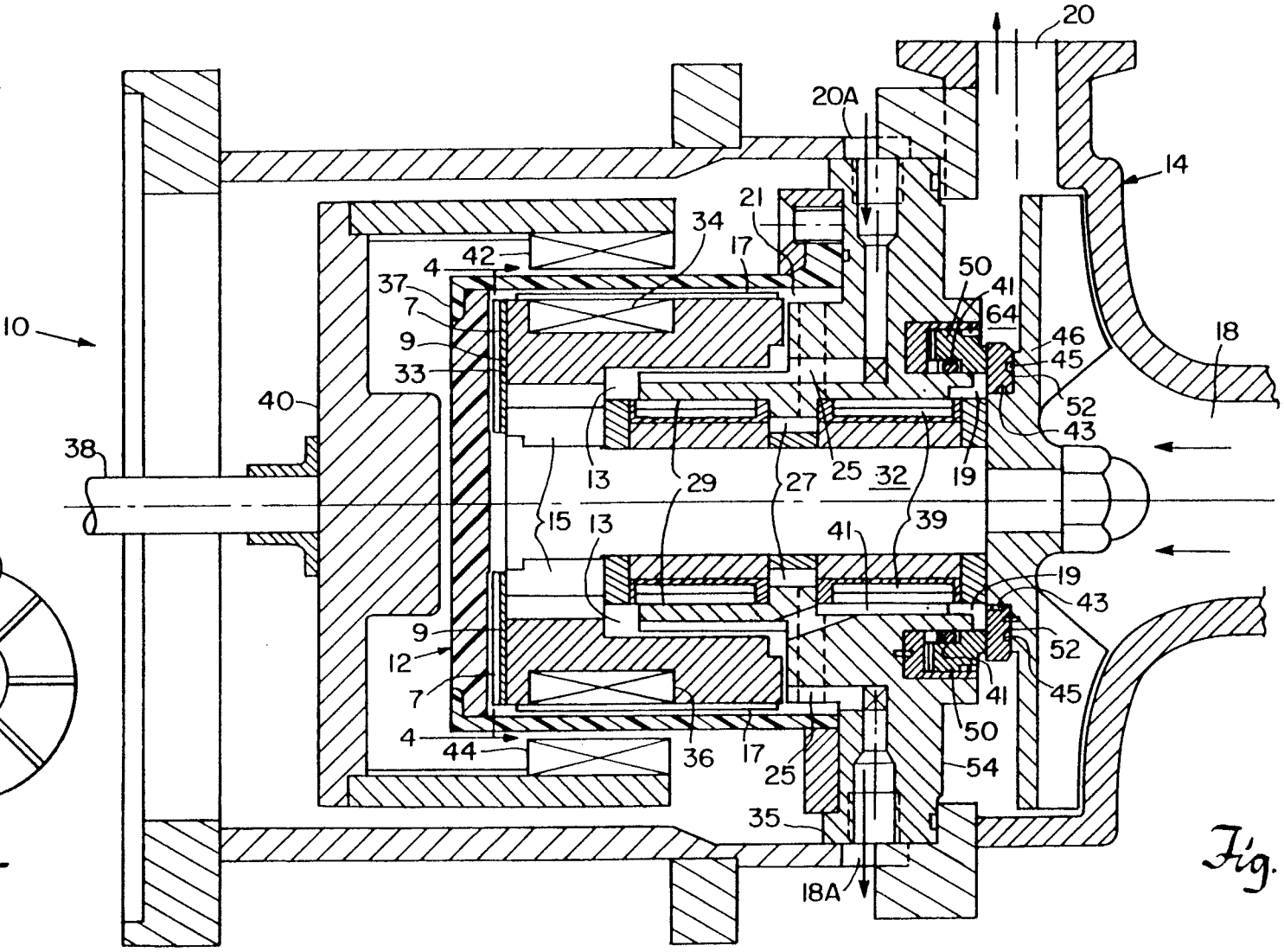
FIG. 1 is a side view in partial cross-section of an embodiment of this invention.

The present invention provides a pump apparatus for preventing leakage from a sealless rotating pump. The sealless rotating pump is a canned motor pump or a magnetic drive pump. The pump apparatus of this invention comprises a pump end, a wear end and an internal pump positioned between the pump end and the wear end. The pump end includes a pumping means positioned on a rotatable shaft which effects an increase in fluid pressure in the pump end when the shaft is rotated. The pump means can be an impeller, a set of meshing gears used in a gear pump, screws, vanes, flexible impeller or the like. Conventional shaft supporting means on the wear end include bearings, thrust washers, magnetic bearings or the like. The wear end is supplied with a liquid, with better lubricating characteristics than the liquid being pumped which is passed through the wear end during use of the pump. An internal pump is positioned on the rotatable shaft between the pump end and the wear end and functions to pump small quantities of lubricating liquid from the wear end to the pump end while preventing passage of fluid from the pump end to the wear end when rotating. It functions as a seal when idle. A stator portion of the wear end is separated from a rotor portion of the wear end by means of a chamber commonly referred to in the art as a can.

A suitable internal pump comprises a stationary ring mounted on a stationary section of a housing for the pump. The stationary ring is positioned to surround the rotatable shaft. A rotatable ring having a face which provides pumping and sealing and is mounted on the rotatable shaft between the pump end and the wear end. The rotating ring can be mounted directly on the shaft or indirectly on the shaft being mounted on an impeller or second rotatable ring or the like, which, in turn, is mounted on the shaft. The surface of the rotatable ring contacts the face of the stationary ring. A pattern or inclined surface on either the rotatable ring or the stationary ring provides fluid communication between the wear end and the pump end when the rotatable shaft is rotated and is configured to increase the pressure of the lubricating liquid in the wear end and to effect passage of small quantities of lubricating liquid from the wear end into the pump end. Since lubricating liquid is pumped into the pump end, passage of fluid from the pump end into the wear end is prevented. When the rotatable shaft is stationary, the stationary ring and the rotatable ring form a seal which prevents fluid flow from the pump end to the wear end.

Referring to FIGS. 1–4, pump 10 includes a stationary housing formed of a wear end housing section 12 and a pump end housing section 14 which are joined together by bolts. The pump 10 includes a fluid inlet 18 and a fluid outlet 20. The pump 10 comprises a rotatable shaft 32 to which is attached a plurality of magnets including magnets 34 and 36. The shaft 32 is positioned within stationary housing 35 includes an outer wall 37. The outer wall 37 seals the annular space 17 and magnets 34 and 36 from the rotating magnets 42 and 44. A drive shaft 38 is secured to rotatable housing 40 to which are attached magnets 42 and 44. The stationary housing 35 includes an outlet 18A and an inlet 20A so that fluid can be pumped through annular spaces 17 and 19 which fluid is sealed from contact with the rotating magnets 42 and 44 by wall or can 37. When the rotatable housing 40 is rotated, the flux fields of magnets 42 and 44 interact with the flux fields of magnets 34 and 36 whether configured as permanent magnet drive or an eddy current drive and thereby cause rotatable shaft 32 to rotate. Rotatable shaft 32 rotates impeller 46 to effect pumping of the liquid within pump 10. Can 37 can be formed of a nonmetallic material so as to prevent eddy currents from being generated during use, thereby reducing power requirements and reducing generated heat. An impeller 9 having vanes 7 can be affixed to surface 33 or surface 31 in order to increase flow of lubricating liquid through spaces 17 and 19. Impeller 9 can be replaced with an external pump (not shown) to pump lubricating liquid, if desired.

Figure 1A:
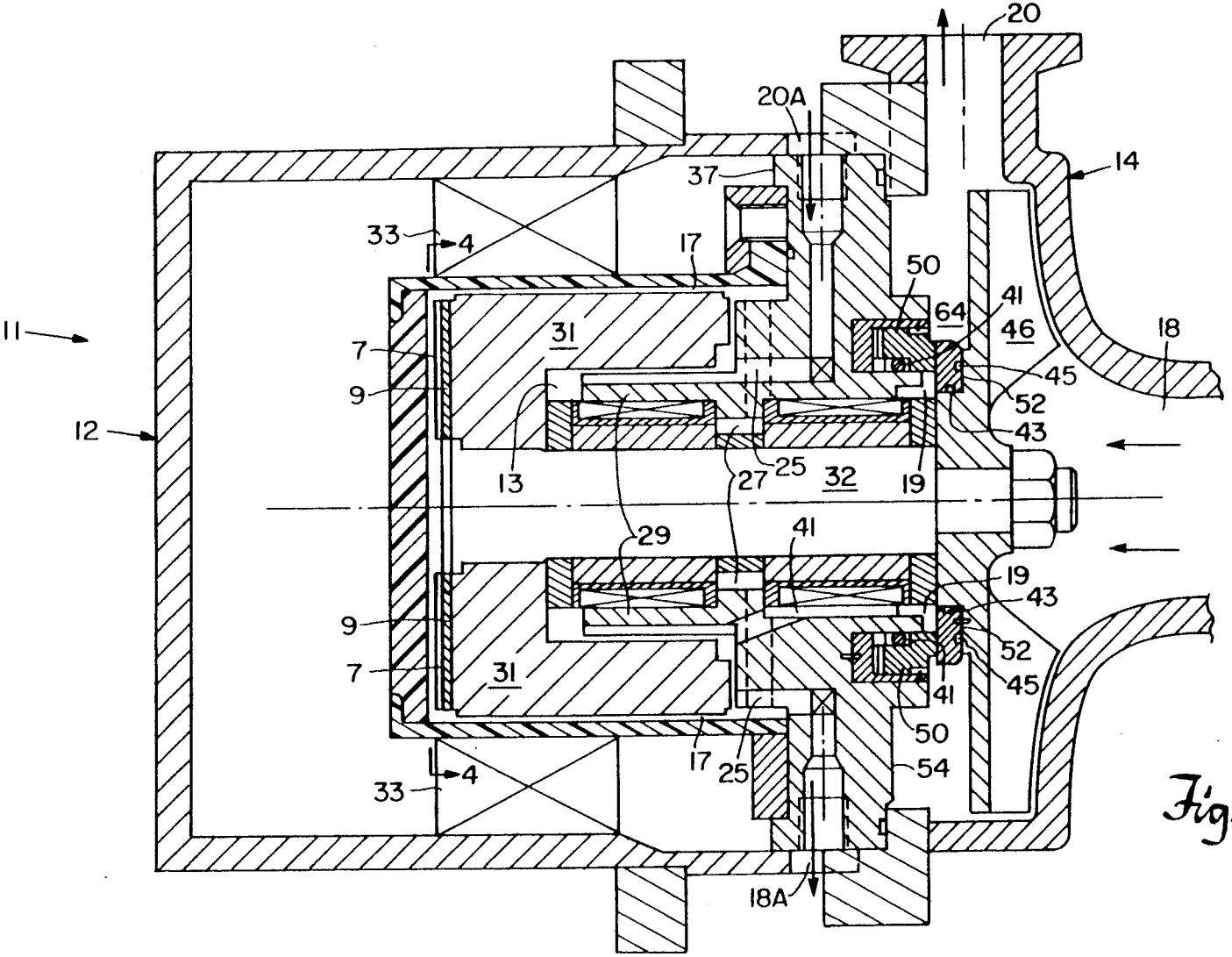
FIG. 1A is a side view in partial cross-section of an alternative embodiment of this invention.

In order to cool the wear end, the lubricating liquid entering inlet 20A, flows into zone 13. At zone 13, the liquid enters holes 15 in magnets 34 and 36 and passes into contact with vanes 7. When vanes 7 on impeller 9 are rotated, lubricating liquid is pumped into zone 17 where it collects heat to be removed from the wear end. This lubricating liquid is passed through zone 21 to the exit 18A. At zone 21, a portion of the lubricating liquid flow is directed through holes 25 to zone 27. From zone 27, liquid divides and feeds through bearings 29 toward zone 13. This liquid cools and lubricates the bearings 29. The remainder of the liquid at zone 27 passes through bearings 39 to effect lubrication and cooling of the bearings 39 and flows into seal area 19 to lubricate and cool the rings 50 and 52. The liquid in zone 19 divides with a portion flowing into outlet 20 and the remainder returning to zone 41 to be recirculated. This lubricating liquid flow path is also generally applicable to the apparatus of FIG. 1A. The apparatus provides a means for cooling the seals and bearings as well as providing fresh lubricating liquid into the wear end of the pump. This, in turn, permits pumping a wide variety of primary liquids, such as those having a temperature above the Curie point of the magnets, i.e., about 625° F. and permits pumping slurries which contain particles of a size which would normally block the gap between the shaft and the bearings. In addition, this apparatus permits running of the pump dry (free of primary liquid being pumped) without damaging the pump.

Figures 2, 3, 5, 6, 7, 8, 9, 10, 11, 12, 13:
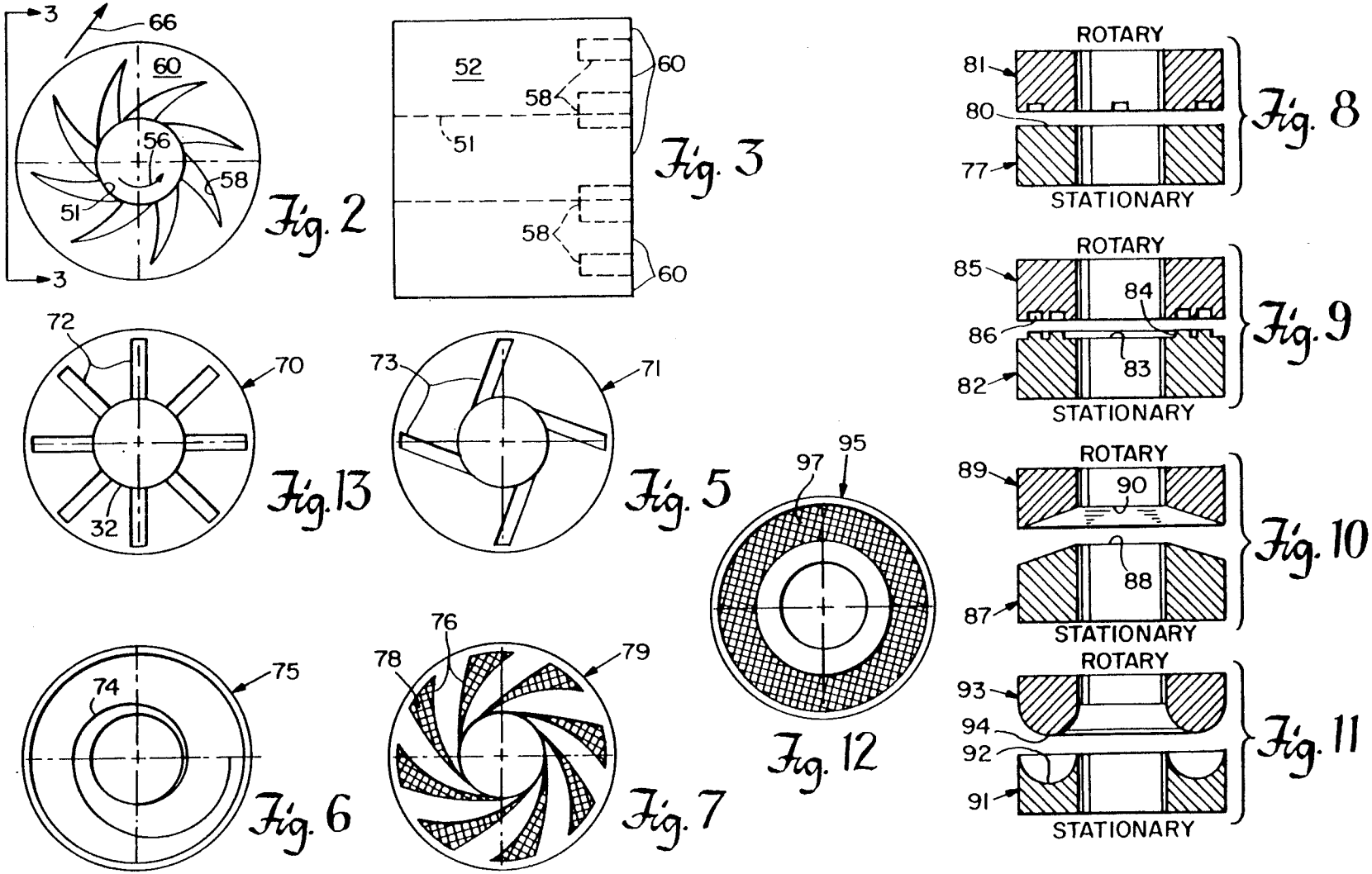
FIG. 2 is a front view of a rotatable ring of an internal pump shown in FIGS. 1 and 1A.
FIG. 3 is a side view of the rotatable ring of FIG. 2 taken along line 3—3.
FIG. 5 is a front view of an alternative rotatable ring of an internal pump useful in this invention.
FIG. 6 is a front view of an alternative rotatable ring of an internal pump useful in this invention.
FIG. 7 is a front view of an alternative rotatable ring of an internal pump useful in this invention.
FIG. 8 is a front view of an alternative rotatable ring of an internal pump useful in this invention.
FIG. 9 is a front view of an alternative rotatable ring of an internal pump useful in this invention.
FIG. 10 is a front view of an alternative rotatable ring of an internal pump useful in this invention.
FIG. 11 is a front view of an alternative rotatable ring of an internal pump useful in this invention.
FIG. 12 is a front view of an alternative rotatable ring of an internal pump useful in this invention.
FIG. 13 is a front view of an alternative rotatable ring of an internal pump useful in this invention.

An internal pump is formed of a stationary ring 50 and a rotatable ring 52. Stationary ring 50 is secured to section 54 of stationary housing section 12. Rotatable ring 52 is fixed to rotatable shaft 32 and is positioned in contact with fixed ring 50. Alternatively, rotatable ring 52 can be mounted on impeller 46, which, in turn is mounted on shaft 32. During rotation, the rings 50 and 52 become slightly separated from each other so that lubricating fluid passes from zone 19 to zone 64. When the ring 52 is stationary, the rings 50 and 52 contact each other to form a seal. The O rings 41, 43 and 45 provide desired sealing. As shown in FIGS. 2 and 3, in one embodiment, rotatable ring 52 includes slots 58 and surfaces 60. The surfaces 60 contact stationary ring 50. Ring 52 is rotated in the direction of arrow 56 in order to pump fluid through the slots 58 in the direction of arrow 66. The slots 58 typically have a depth of about 0.0001 to 0.0003 inch which permits pumping of only small amounts of lubricating fluid from zone 19 into zone 64 and then through outlet 20. It is to be understood that this invention can be utilized with any rotatable sealless pump.

Referring to FIGS. 1A, 2, 3 and 4, a canned pump 11 includes a stationary housing formed of a wear end housing section 12 and a pump end housing section 14 which are joined together by bolts. The pump 11 includes a fluid inlet 18 and a fluid outlet 20. The pump 11 comprises a rotatable shaft 32 to which is attached a rotor 31, having an impeller 9 with vanes 7 positioned within windings 33. The stationary housing 37 seals annular spaces 17 as well as rotor 31 from the windings 33. The stationary housing 37 can be formed of a nonmetallic material. The stationary housing 37 includes an outlet 18A and an outlet 20A so that fluid can be pumped through annular spaces 17 and 19. Rotatable shaft 32 rotates impeller 46 to effect pumping of the liquid within pump 11.

An internal pump is formed of a stationary ring 50 and a rotatable ring 52. Stationary ring 50 is secured to section 54 of stationary housing section 12. Rotatable ring 52 is fixed to rotatable shaft 32 and is positioned in contact with fixed ring 50. As shown in FIGS. 2 and 3, rotatable ring 52 includes a cental hole 51 for a shaft, slots 58 and surfaces 60. The surfaces 60 contact stationary ring 50. Ring 52 is rotated in the direction of arrow 56 in order to pump fluid through the slots 58 in the direction of arrow 66. The slots 58 typically have a depth of about 0.0001 to 0.0003 inch which permits pumping of only small amounts of lubricating fluid from zone 19 into zone 64 and then through outlet 20. The O rings 41, 43 and 45 provide the desired sealing. Cooling is effected in zones 17, 19, 25, 27 and 29 in the manner described above with reference to FIG. 1.

Referring to FIGS. 5-7,12 and 13, alternative rotatable rings are shown which contact a stationary ring having a flat surface and function as described above with reference to FIGS. 2 and 3. A plurality of slots 72 extend from the shaft 32. As shown in FIG. 5, the rotatable ring 71 includes a plurality of angled slots 73. As shown in FIG. 6, a spiral shaped slot 74 is utilized on the rotatable ring 75. As shown in FIG. 7, sail shaped slots 76 having a plurality of pockets 78 is utilized on rotatable ring 79. As shown in FIG. 12, the rotatable ring 95 includes a ring shaped indentation 97. As shown in FIG. 13, a rotatable ring 70 is positioned on shaft 32.

Figure 4:
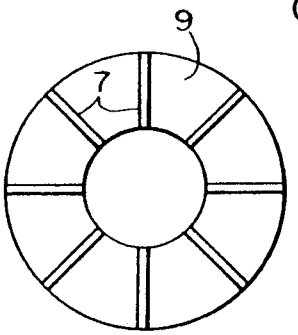
FIG. 4 is a front view of an impeller taken along line 4—4 of FIG. 1 and 1A.

Referring to FIGS. 8-11, arrangments of a rotatable ring and a stationary ring are shown wherein the stationary ring has a non-flat or flat surface. As shown in FIG. 8, the stationary ring 77 has a flat surface 80 and rotatable ring 81 has indentations such as are shown in FIGS. 2, 4 and 5. As shown in FIG. 9, stationary ring 82 has a surface 83 with a labyrinth 84 while rotatable ring 85 has a mating labyrinth 86. AS shown in FIG. 10, stationary ring 87 has a raised central surface 88 while rotatable ring 89 has a mating indented surface 90. As shown in FIG. 11, stationary ring 91 has a surface with a circular indentation 92 while rotatable ring 93 has a mating surface 94. Other suitable arrangements of a rotatable ring and a stationary ring are disclosed in U.S. Pat. Nos. 4,290,611 and 5,090,712 which are incorporated herein by reference.

Figure 14:
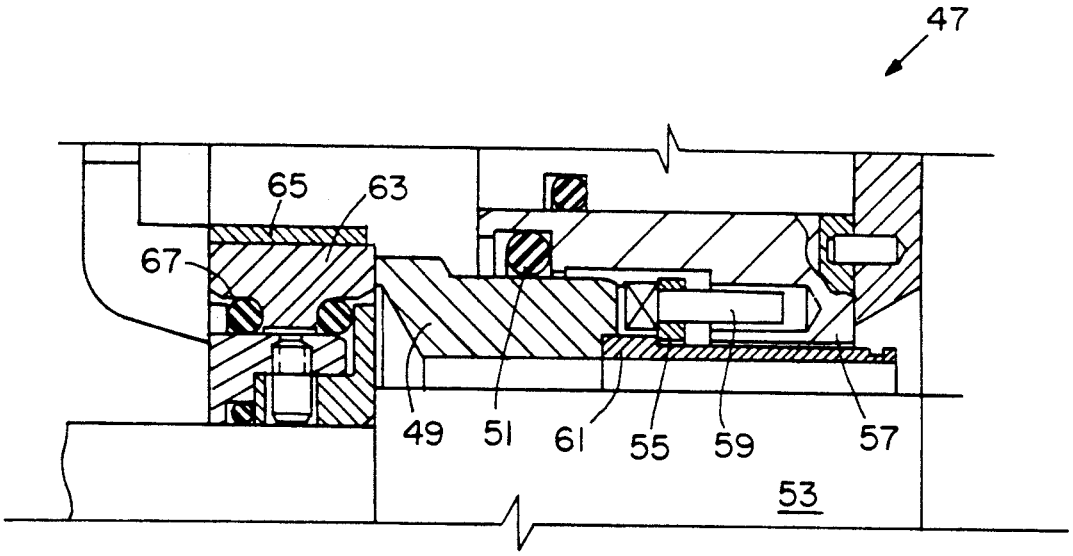
FIG. 14 is a one-half cross-sectional view of an alternative internal pump useful in this invention.

Referring to FIG. 14, an alternative internal pump useful in the present invention is shown. The internal pump 47 includes a stationary ring comprising an inclined seal face 49, an O ring 57, a rotatable shaft 53, a thrust ring 55, a stationary housing 57, a pin 59 and a sleeve 61. The rotating ring 63 mounted on shaft 53 comprises a rotating face in contact with the flat portion of face 49 which is flat, a shrunk in ring 65 and an O ring 67. When rotation is effected, lubricating liquid passes between stationary face 49 and rotating face 63. Examples of these types of internal pumps are available from Burgmann Seals America, Inc., Houston, Tex. and identified as their HR series and from Durometallic Corporation, Kalamazoo, Mich. and identified as the SL-Series Dura Seal.

Figure 15:
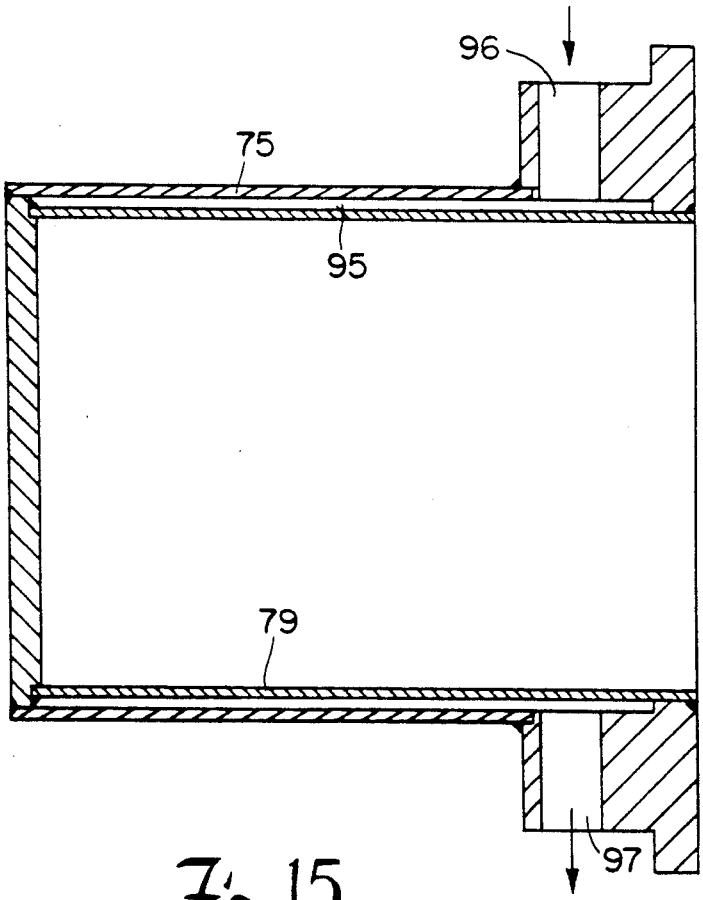
FIG. 15 is a cross-sectional view of an alternative can construction useful in the pump of FIGS. 1 and IA.

Referring to FIG. 15, a dual can construction suitable for use in this invention includes dual walls 75 and 79 separated from each other to form a cylindrical space 95. A cooling liquid or gas can be introduced into inlet 96, into space 95 and out outlet 97. This cooling means can be utilized to supplement the cooling means described above. The dual can construction can be formed of metal or non-metal.

The pumps of this invention provide substantial advantages over prior art sealless pumps comprising canned motor pumps or magnetic drive pumps. By the use of two fluids, the primary pumped fluid and the lubricating liquid under conditions wherein the pumped fluid is excluded from the wear end of the pump, any pumped fluid regardless of chemical or physical characteristics can be pumped so long as degradation of the pump end is not effected. Thus, liquid corrosive to the wear end, slurries or high temperature fluids can be processed without wear to the wear end. In addition, cans, i.e., seals between the stator and rotor sections at the wear end of the pump can be formed of nonmetallic compositions. Thus losses due to eddy currents can be avoided thereby improving energy and cooling efficiencies substantially.

I claim:

1. A pump comprising a rotatable shaft mounted in a wear end of said pump, said wear end including, a rotor, means for effecting rotation of said rotor and said shaft and a housing seal between said means for effecting rotation and said rotor, a pump means mounted on said rotatable shaft in a pump end of said pump, means for introducing a first liquid into said pump end, means for removing said first liquid from said pump end, means for introducing a second liquid into said wear end, means for removing said second liquid from said wear end, an internal pump positioned between said pump end and said wear end on said rotatable shaft, said internal pump comprising a rotatable ring connected to said shaft and having a first face contacting a second face on a stationary ring, said first face and second face having a surface configuration which effects pumping of said second liquid in said wear end to said pump end while preventing said first liquid in said pump end from entering said wear end when said shaft is rotated, said internal pump sealing said pump end from said wear end when said shaft is not rotated and means for cooling said wear end.

2. The pump of claim 1 wherein said second face includes an inclined surface.

3. The pump of claim 1 wherein said pump means comprises an impeller mounted on said rotatable shaft.

4. The pump of claim 1 wherein said first face includes indentations.

5. The pump of claim 4 wherein said pump means comprises an impeller mounted on said rotatable shaft.

6. The pump of claim 1 wherein said means for effecting rotation of said rotor end and said shaft comprises windings.

7. The pump of claim 1 wherein said rotor comprises rotatable magnet means.

8. The pump of claim 1 wherein said means for effecting rotation of said rotor and said shaft comprises rotating magnet means.

9. The pump of claim 6 wherein said rotor comprises a rotatable torque ring.

10. The pump of any one of claims 1, 8, 6, 7 or 9 wherein said second liquid is a liquid hydrocarbon.

11. The pump of any one of claims 1, 8, 6, 7 or 9 which includes an impeller on said rotor for pumping said second liquid.

12. The pump of any one of claims 1, 8, 6, 7 or 9 wherein said rotatable ring is mounted on rotatable means, said rotatable means being mounted on said shaft.

13. The pump of any one of claim 1, 8, 6, 7 or 9 wherein said rotatable ring is mounted directly on said shaft.

* * * * *

Adverse Decisions In Interference

Patent No 5,288,213, Ali M. Nasr, PUMP HAVING AN INTERNAL PUMP, Interference No. 103,927, final judgment adverse to the patentee rendered September 3, 1998, as to claims 1-13.
*(Official Gazette October 27, 1998)*